US006032912A

United States Patent [19]

Korn et al.

[11] Patent Number: 6,032,912

[45] **Date of Patent: *Mar. 7, 2000**

[54] ONE-PIECE METAL CABINET BASE AND METHOD OF CONSTRUCTION

[75] Inventors: Francis Korn; Thomas Chittenden, both of Durham, Conn.

[73] Assignee: The Durham Manufacturing Company, Durham, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/846,183

[22] Filed: Apr. 28, 1997

[51] Int. Cl.[7] ..... A47B 91/00

[52] U.S. Cl. ..... 248/346.01; 248/346.3; 211/135; 211/72; 312/258

[58] Field of Search ..... 248/174, 346.01, 248/346.3, 346.5; 211/135, 149, 72, 73

[56] References Cited

U.S. PATENT DOCUMENTS

| | | | |
|---|---|---|---|
| Re. 32,668 | 5/1988 | Smith | 211/149 |
| 1,336,973 | 4/1920 | Levene | 248/174 |
| 1,377,824 | 5/1921 | Forbes | 248/346.01 |
| 1,609,945 | 12/1926 | Hermani | 211/135 |
| 2,801,145 | 7/1957 | Jones | 248/346.3 |
| 3,533,584 | 10/1970 | Rohrbach | 248/174 |
| 4,062,302 | 12/1977 | Krizan | 108/60 |
| 4,265,501 | 5/1981 | Halliburton | 312/108 |
| 4,530,548 | 7/1985 | Spamer | 312/45 |
| 5,016,545 | 5/1991 | Robertson et al. | 108/111 |
| 5,213,220 | 5/1993 | McBride | 211/132 |
| 5,315,936 | 5/1994 | Smith | 108/165 |
| 5,382,087 | 1/1995 | Pouch | 312/140.2 |
| 5,692,714 | 12/1997 | Morrison | 248/174 |
| 5,706,959 | 1/1998 | Smith | 211/132 |

*Primary Examiner*—Derek J. Berger
*Assistant Examiner*—Kimberly Wood
*Attorney, Agent, or Firm*—John H. Crozier

[57] ABSTRACT

In a preferred embodiment, a one-piece cabinet base, including: a horizontal, generally rectangular, planar, cabinet receiving surface on which to place a cabinet; vertical supports at either end of the horizontal surface, formed of one piece with the horizontal surface and depending therefrom; and horizontal base plates at lower ends of the vertical supports and formed of one piece with the vertical supports.

3 Claims, 7 Drawing Sheets

ONE-PIECE METAL CABINET BASE AND METHOD OF CONSTRUCTION

BACKGROUND OF THE INVENTION

1. Field of the Invention.

The present invention relates to cabinet bases generally and, more particularly to a novel one-piece metal cabinet base of simple construction.

2. Background Art.

Cabinet bases are used, for example, to elevate parts cabinets, for example, to a more convenient height for accessing the contents of the cabinets. Conventionally, such a base is constructed of multiple parts with legs and possibly end pieces and gussets, with the many parts spot welded, bolted, and/or rivetted to each other and to a horizontal platform on which the cabinet is to be placed. Such a construction requires multiple operations and, consequently, is relatively costly. It would be desirable to provide a cabinet base that is simple in construction.

Accordingly, it is a principal object of the present invention to provide a cabinet base that is of one-piece construction.

It is a further object of the invention to provide such a cabinet base that is manufactured with a minimum of different fabrication operations.

It is an additional object of the invention to provide such a cabinet base that is economical to manufacture.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a one-piece cabinet base, comprising: a horizontal, generally rectangular, planar, cabinet receiving surface on which to place a cabinet; vertical supports at either end of said horizontal surface, formed of one piece with said horizontal surface and depending therefrom; and horizontal base plates at lower ends of said vertical supports and formed of one piece with said vertical supports.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
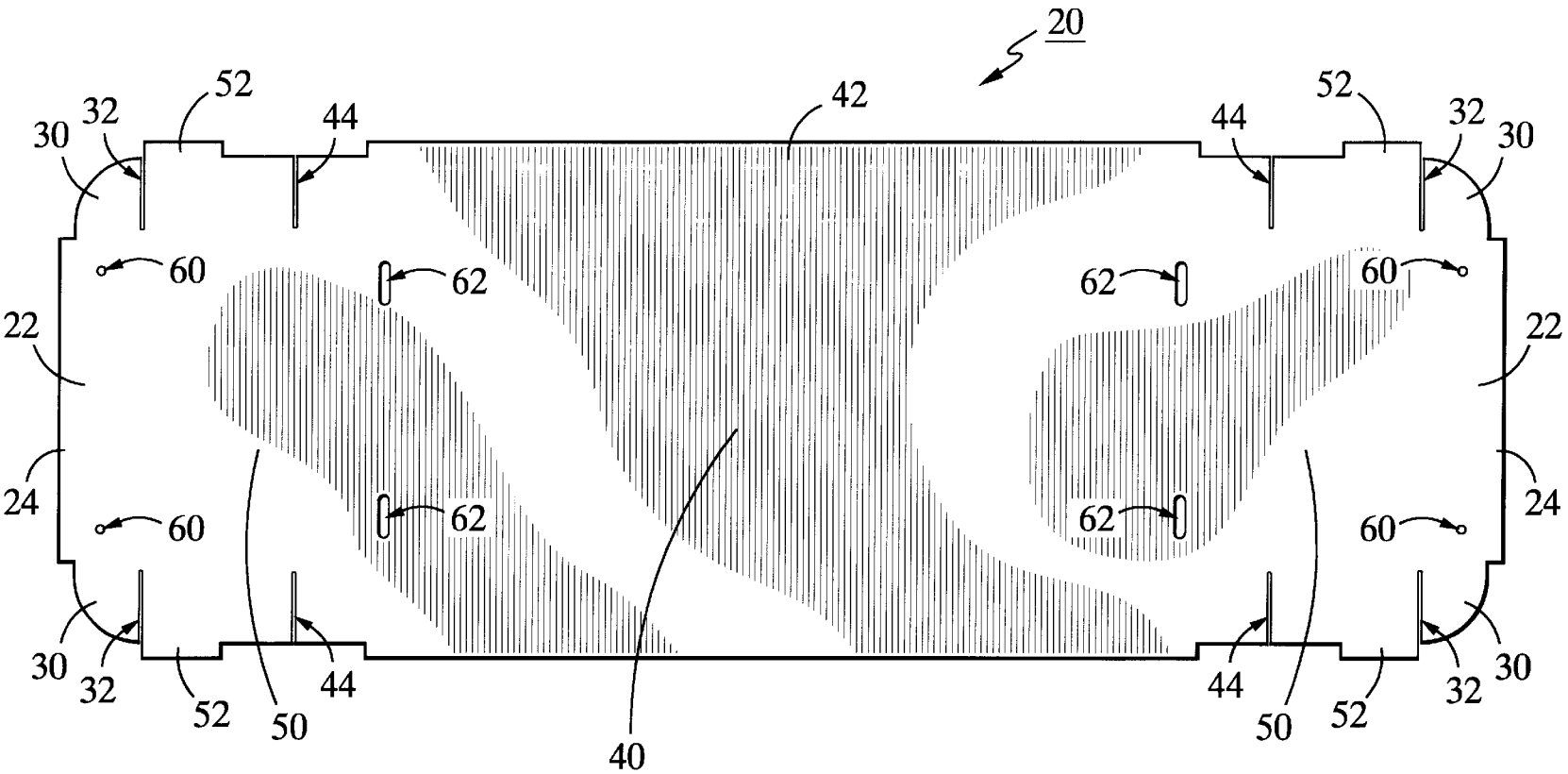
FIG. 1 is a top plan view of a metal blank for construction of a cabinet base according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a flat, metal, cabinet base form, generally indicated by the reference numeral 20. Form 20 is generally rectangular in shape and the various elements thereof, described below, may be formed in a single, conventional blanking operation.

The ends of opposite end regions 22 of form 20 have extending outwardly therefrom elongated narrow flanges 24 extending substantially the width of the end regions. The sides of end regions 22 terminate in quarter circle elements 30 partially defined by, and separated from, the rest of form 20 by widthwise slits 32 defined through the form and extending partially thereinto.

A broad central region 40 of form 20 has extending outwardly from sides thereof elongated narrow flanges 42 extending substantially the length of the central region. Central region 40 terminates lengthwise at widthwise slits 44 defined through form 20 and extending partially thereinto.

Defined lengthwise between slit pairs 32/44, between end regions 22 and central region 40, and extending widthwise across form 20 are intermediate regions 50. Extending outwardly from the lengthwise half of the sides of intermediate regions adjacent slits 32 are narrow elongated flanges 52.

Mounting holes 60 are defined through end regions 22 and mounting slits 62 are defined through central region 40, the functions of the holes and slits being described below.

Figure 2:
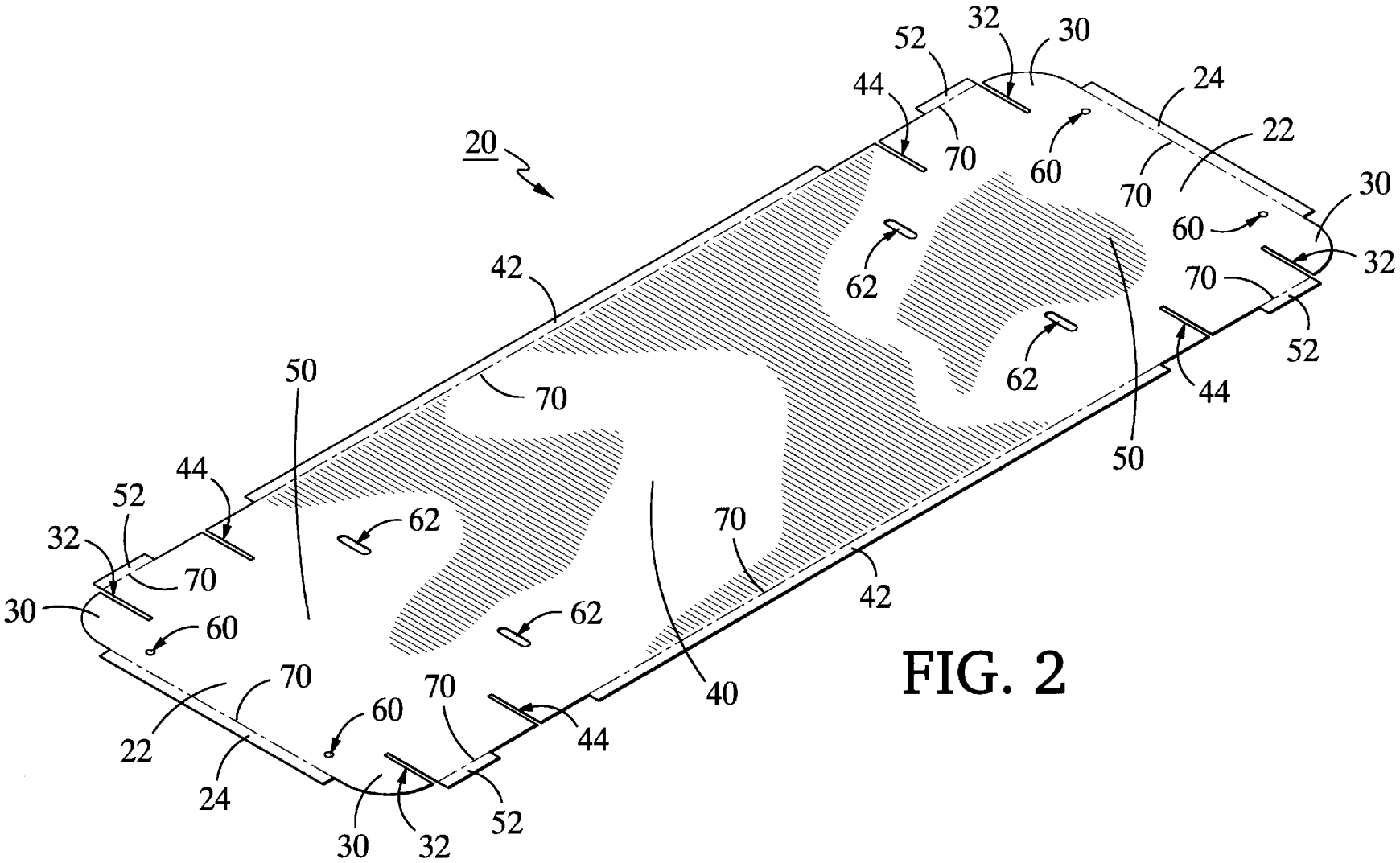
FIG. 2 is an isometric view of the metal blank indicating the locations of first folds to be made in the blank in forming the cabinet base.

FIG. 2 illustrates form 20 as shown on FIG. 1 and further illustrates first, straight fold lines 70 along which flanges 24, 42, and 52 are to be folded.

Figure 3:
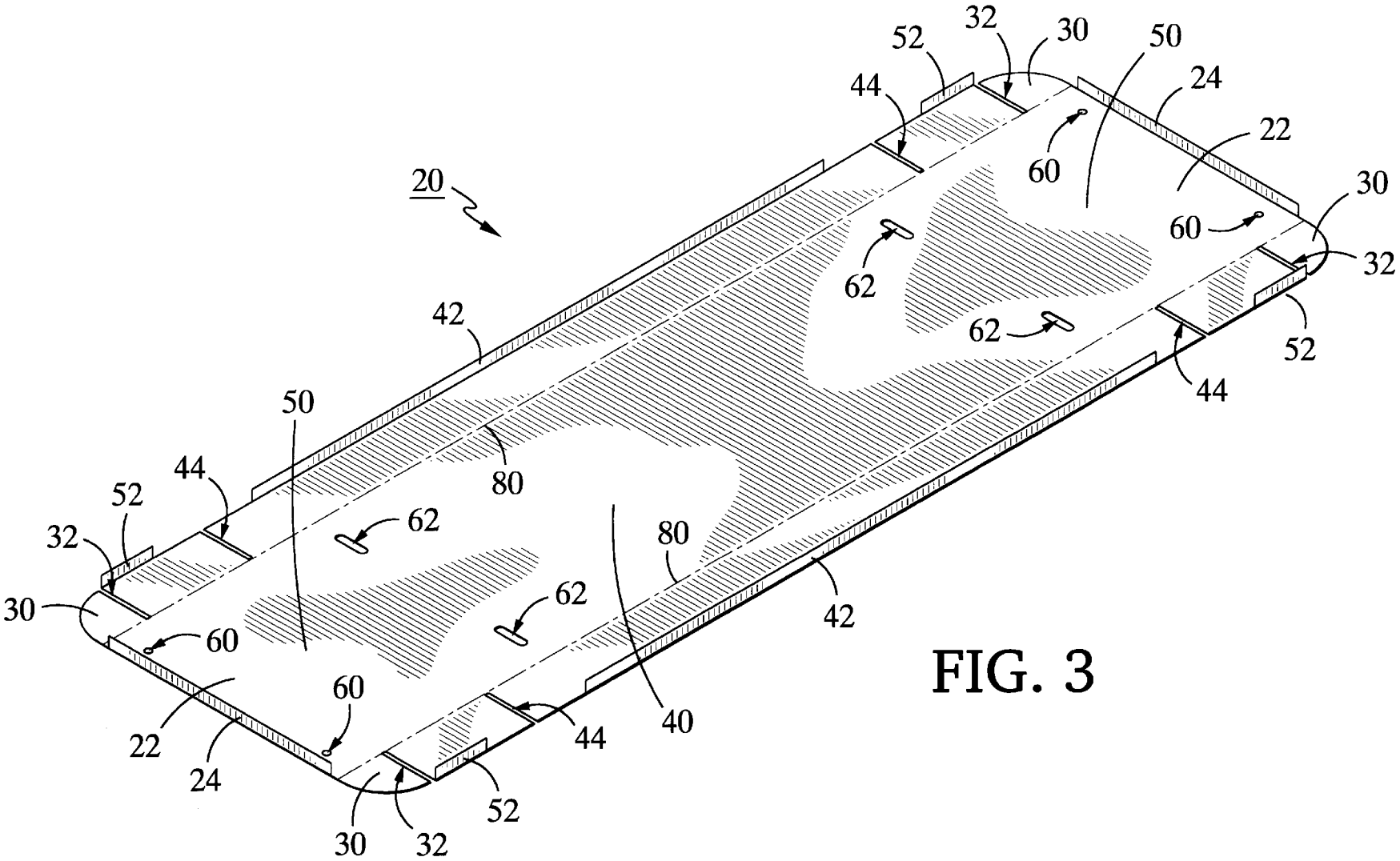
FIG. 3 is an isometric view showing the blank after the first folds have been made and indicating the locations of second folds to be made.

FIG. 3 illustrates flanges 24, 42, and 52 folded upwardly, orthogonally to the plane of central region 40, along, respectively, end regions 22, the central region, and intermediate regions 50, to form reinforcing flanges along the edges of those regions. The folding operations may be easily performed with a conventional brake. FIG. 3 also illustrates two, second, parallel fold lines 80 extending the length of form 20 and intersecting the roots of slits 32 and 44.

Figure 4:
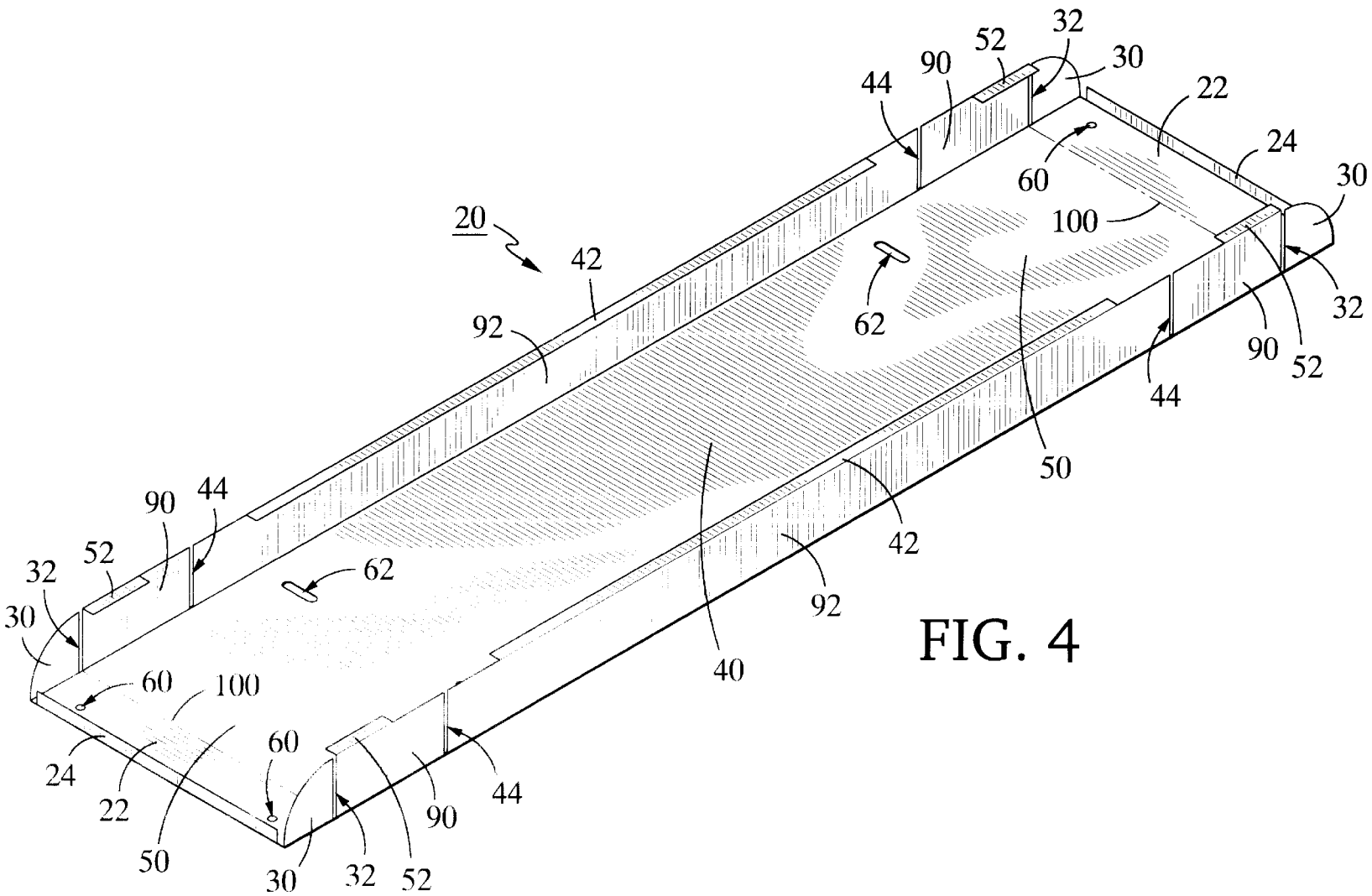
FIG. 4 is an isometric view after the second folds have been made and indicating the locations of third folds to be made.

FIG. 4 illustrates certain elements of form 20 having been folded upwardly, orthogonally to the plane of central region 40, along second fold lines 80 (FIG. 3), these elements being quarter circle elements 30, rectangular areas 90 of intermediate regions 50 lying between slits 32 and 44 and fold lines 80, and rectangular areas 92 of central region 40 lying between slits 44 and fold lines 80. FIG. 4 also illustrates third fold lines 100 extending widthwise between end regions 22 and intermediate regions 50.

Figure 5:
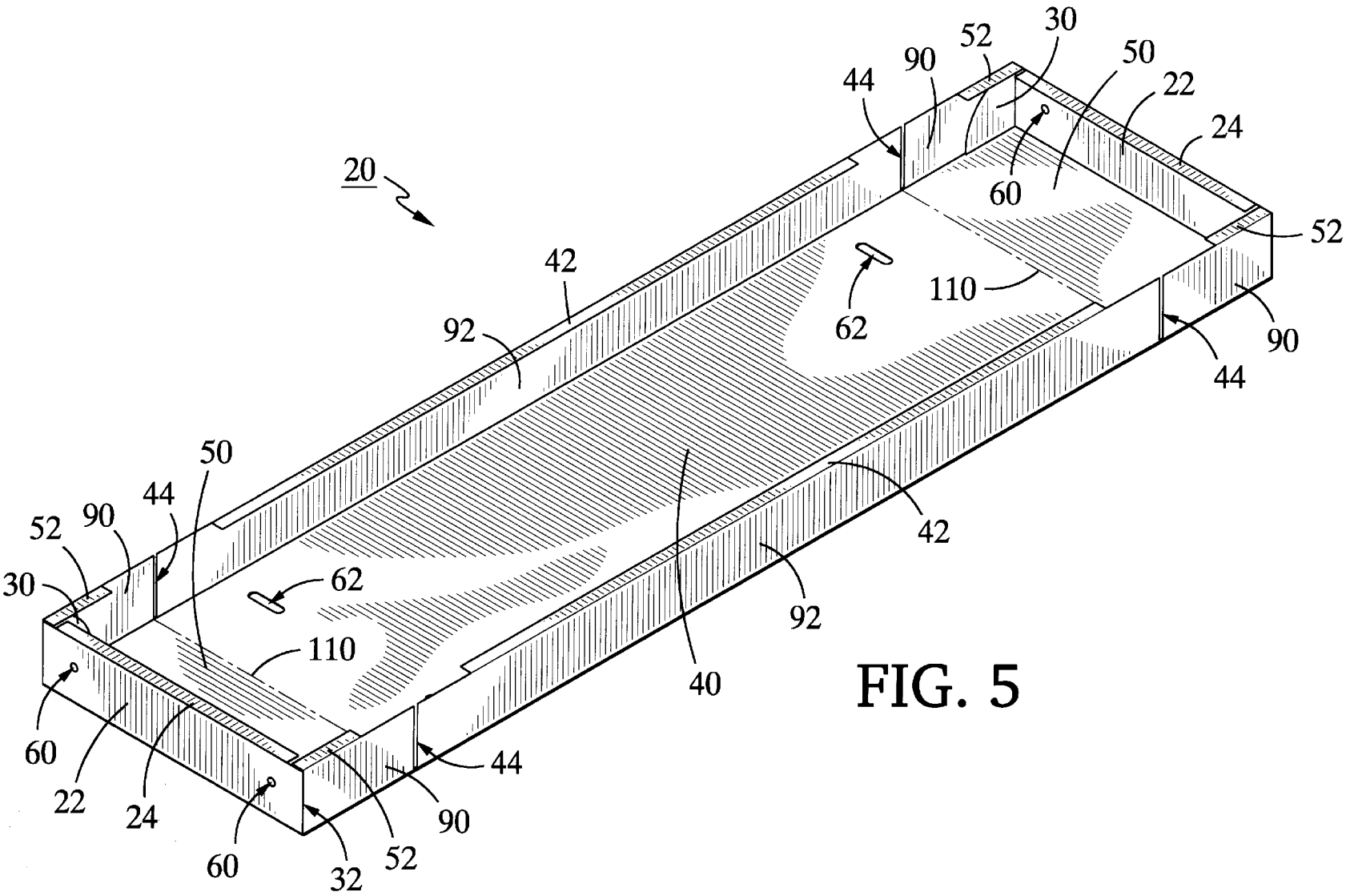
FIG. 5 is an isometric view after the third folds have been made and indicating the locations of fourth folds to be made.

FIG. 5 illustrates end regions 22 having been folded upwardly, orthogonally to central region 40, along fold lines 100 (FIG. 4), with quarter circle elements 30 lying adjacent the inner surfaces of areas 90 of intermediate regions 50. FIG. 5 also illustrates fourth, straight, parallel fold lines 110 extending widthwise between slits 44 between central region 40 and intermediate regions 50.

Figure 6:
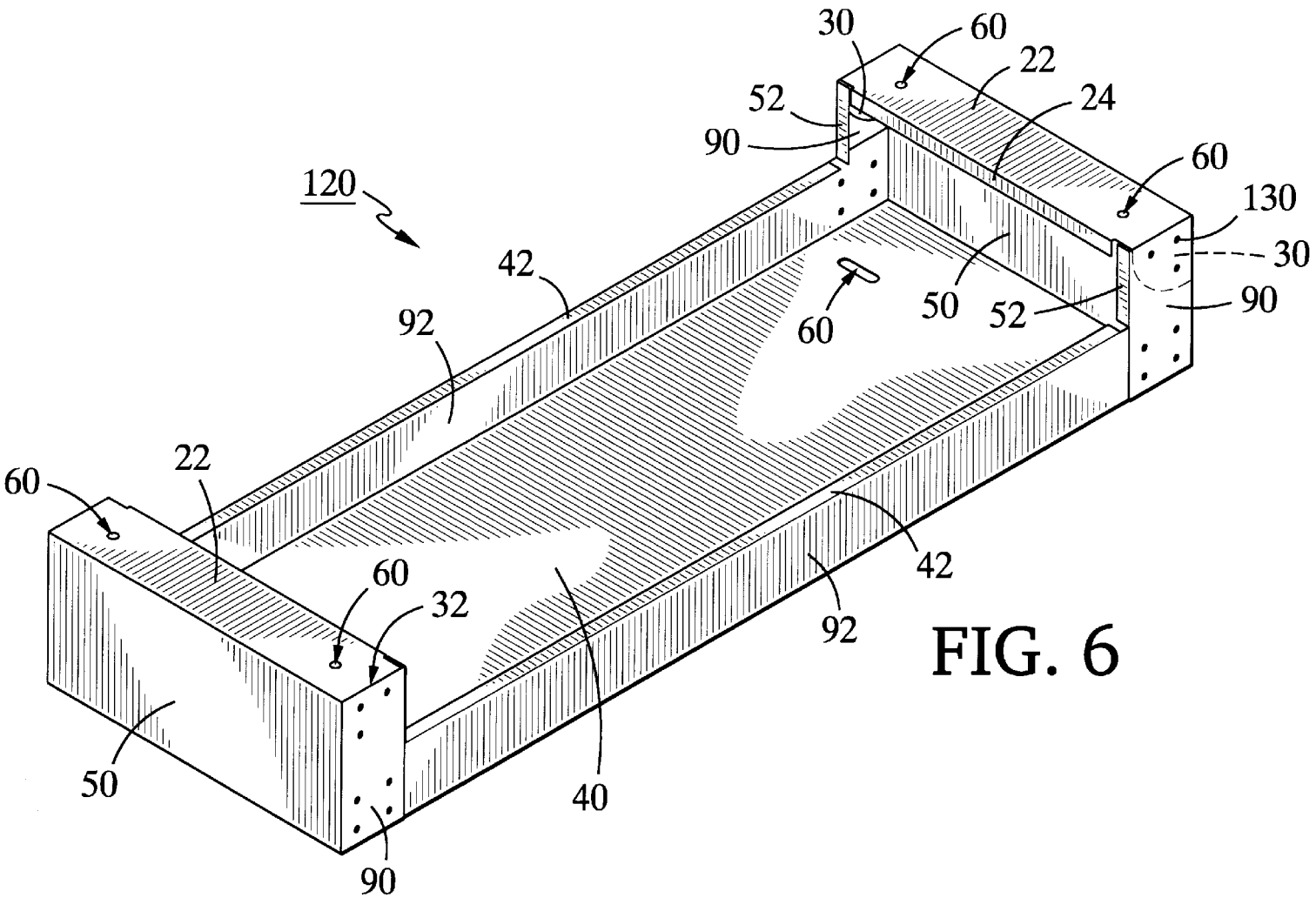
FIG. 6 is an isometric view, inverted, of the completed cabinet base.

FIG. 6 illustrates intermediate regions 50 having been folded upwardly, orthogonally to central region 40, along fold lines 110 (FIG. 5).

The above folding operations have converted form 20 to the cabinet base of the present invention, generally indicated by the reference numeral 120, shown inverted on FIG. 6. Construction of cabinet base 120 is completed by spot welding, as at 130, areas 90 to areas 92 and to quarter circle elements 30. Spot welding is the only operation other than blanking and folding required for the construction of cabinet base 120. Cabinet base 120 may then be painted or otherwise finished as desired. End regions 22 serve as base plates for cabinet base 120, with mounting holes 60 being available for attachment of the cabinet base to an underlying structure (not shown). Intermediate regions 50 serve as vertical legs for central region 40. The other elements of cabinet base 120 serve as reinforcement members for end regions 22, central region 40, and intermediate regions 50.

Figure 7:
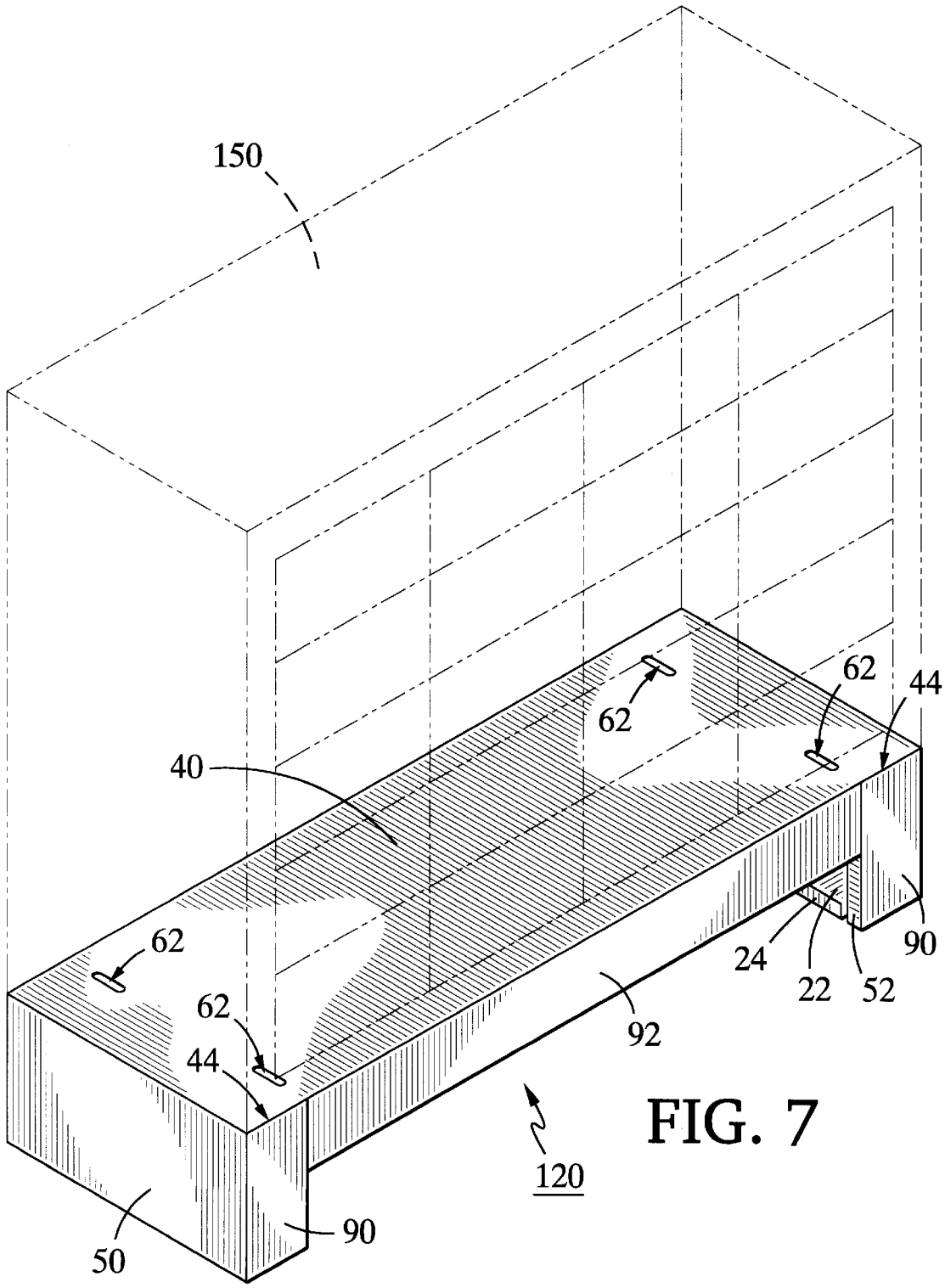
FIG. 7 is an isometric view of the completed cabinet base with a parts cabinet disposed thereon.

FIG. 7 illustrates cabinet base 120 in use, with a cabinet 150 disposed on central region 40. Mounting slots 62 may be used to attach cabinet 150 to cabinet base 120 with suitable fasteners (not shown). It will be understood that the selected length of intermediate regions 50 between slit pairs 32/44 will be the height of central region 40 above the surface (not shown) on which cabinet base 120 is disposed.

We claim:

1. A cabinet and a one-piece cabinet base, comprising:

(a) a horizontal, generally rectangular, planar, cabinet receiving surface on which to place said cabinet;

(b) vertical supports at either end of said horizontal surface, formed of one piece with said horizontal surface and depending therefrom;

(c) horizontal base plates at lower ends of said vertical supports and formed of one piece with said vertical supports;

(d) first vertical side panels depending from side edges of said horizontal surface; and (e) second vertical side panels formed of one piece with said vertical supports and attached to said base plates and said first vertical side panels;

(f) narrow, elongated reinforcing flanges extending orthogonally from edges of said base plates and said first and second vertical panels;

(g) said cabinet disposed on said cabinet receiving surface.

2. A method of providing a one-piece cabinet base for a cabinet, comprising:

(a) forming a generally rectangular, horizontal, flat, metal form having: a broad, central, cabinet receiving region having extending outwardly therefrom elongated first narrow flanges extending substantially the length of said central region, said central region terminating lengthwise at four, widthwise first slits defined through said form and extending from opposite edges thereof and partially thereinto; two intermediate regions extending lengthwise from ends of said central portion, extending widthwise across said form and defined lengthwise between said first slits and four widthwise second slits defined through said form and extending from opposite edges thereof and partially thereinto, said intermediate regions having elongated second narrow flanges extending outwardly from the lengthwise half of the sides of said intermediate regions adjacent said second slits; opposite end regions extending outwardly lengthwise from ends of said intermediate regions and having extending outwardly therefrom elongated third narrow flanges extending substantially the length of said end regions; and sides of said end regions terminating in two quarter circle elements partially defined by said second slits;

(b) folding said first, second, and third flanges upwardly orthogonally to said central region to form reinforcing flanges along edges of said central region, said intermediate regions, and said end regions;

(c) folding upwardly, orthogonally to said central region, said quarter circle elements, first rectangular areas of said intermediate regions lying between said first and second slits, and second rectangular areas of said central region lying between said first slits;

(d) folding upwardly, orthogonally to said central region, and along two, parallel, lengthwise fold lines intersecting roots of said first and second slits, said end regions, with said quarter circle elements lying adjacent inner surfaces of said first rectangular areas;

(d) folding upwardly, orthogonally to said central regions, along two, parallel, widthwise fold lines extending between roots of said second slits, said intermediate regions, with inner surfaces of said first areas lying adjacent outer surfaces of said second areas; and (e) placing said cabinet on said cabinet receiving region.

3. A method, as defined in claim 2, further comprising spot welding said first areas to said second areas and to said quarter circle elements.

* * * * *